US009333513B2

(12) United States Patent
Muller et al.

(10) Patent No.: US 9,333,513 B2
(45) Date of Patent: May 10, 2016

(54) ELECTROSTATIC FINE DUST FILTER SYSTEM, RETAINER FOR AN ELECTRODE, AND ELECTRODE THEREFOR

(76) Inventors: Beat Muller, Maienfeld (CH); Daniel Jud, Schonenberg (CH)

( * ) Notice: Subject to any disclaimer, the term of this patent is extended or adjusted under 35 U.S.C. 154(b) by 1028 days.

(21) Appl. No.: 13/988,486

(22) PCT Filed: Nov. 18, 2010

(86) PCT No.: PCT/CH2010/000291
§ 371 (c)(1),
(2), (4) Date: Nov. 25, 2013

(87) PCT Pub. No.: WO2011/060562
PCT Pub. Date: May 26, 2011

(65) Prior Publication Data

US 2014/0083297 A1 Mar. 27, 2014

(30) Foreign Application Priority Data

Nov. 18, 2009 (CH) ..... 1772/09

(51) Int. Cl.
*B03C 3/49* (2006.01)
*B03C 3/41* (2006.01)
*B03C 3/86* (2006.01)

(52) U.S. Cl.
CPC ... *B03C 3/49* (2013.01); *B03C 3/41* (2013.01); *B03C 3/86* (2013.01); *B03C 2201/08* (2013.01); *B03C 2201/10* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 3,773,966 | A | * | 11/1973 | Ebert et al. | 96/50 |
| 3,966,436 | A | * | 6/1976 | Archer | 96/91 |
| 4,134,040 | A | * | 1/1979 | Klotzman | 313/271 |
| 4,251,682 | A | * | 2/1981 | Ebert et al. | 95/57 |
| 4,634,806 | A | * | 1/1987 | Haag et al. | 174/211 |
| 4,671,808 | A | | 6/1987 | Goeransson | |
| 4,743,277 | A | * | 5/1988 | Hartmann | 96/37 |
| 5,003,774 | A | * | 4/1991 | Leonard | 96/52 |
| 5,334,238 | A | * | 8/1994 | Goodson et al. | 95/59 |
| 6,517,608 | B2 | * | 2/2003 | McDermott et al. | 95/58 |
| 2008/0190294 | A1 | | 8/2008 | Sato | |

FOREIGN PATENT DOCUMENTS

| | | | |
|---|---|---|---|
| BE | 369515 | A | 4/1930 |
| DE | 3308265 | A1 | 10/1984 |

(Continued)

*Primary Examiner* — Duane Smith
*Assistant Examiner* — Sonji Turner
(74) *Attorney, Agent, or Firm* — Morriss O'Bryant Compagni, PC

(57) ABSTRACT

The invention relates to a retainer for an electrostatic high-voltage electrode, containing a high-voltage insulator, on the electrode side of the insulator at least one arm having a retaining means for retaining a high-voltage electrode hanging on the retaining means preferably vertically, and on the installation side of the insulator at least one installation means for installing the retainer at an installation point outside an exhaust gas channel of a chimney. Said retainer is characterized in that the retainer is equipped with at least one restoring element, which forms an articulated connection between the at least one installation means and the retaining means and which allows the retaining means and optionally a high-voltage electrode attached thereto to move out of the way from the operating position during cleaning in the exhaust gas channel with a cleaning device and allows an automatic return to the operating position.

17 Claims, 8 Drawing Sheets

(56) References Cited

FOREIGN PATENT DOCUMENTS

| | | | |
|---|---|---|---|
| DE | 3539205 | A1 | 5/1986 |
| DE | 102006003028 | A1 | 8/2007 |
| FR | 626445 | A | 9/1927 |
| GB | 914299 | A | 1/1963 |
| GB | 2119291 | A | 11/1983 |
| WO | 2008128353 | A1 | 10/2008 |

* cited by examiner (a) (b)

ELECTROSTATIC FINE DUST FILTER SYSTEM, RETAINER FOR AN ELECTRODE, AND ELECTRODE THEREFOR

CROSS-REFERENCE TO RELATED APPLICATIONS

This application is a national phase entry under 35 U.S.C. §371 of PCT/CH2010/000291 filed Nov. 18, 2010, which claims priority to Swiss Patent Application No. 1772/09 filed Nov. 18, 2009, the entirety of each of which is incorporated by this reference.

BACKGROUND

1. Field of the Invention

The invention relates to a holder for an electrostatic high-voltage rod-shaped electrode, in particular an electrostatic high-voltage electrode and to an electrostatic fine dust filter system. The invention also relates to the use of specific materials for producing an electrode. The holder, electrode and/or fine dust filter system can be used for waste gas purification, in particular of fireplaces and hearths.

2. Prior Art

Electrostatic dust filters, also termed electrostatic precipitators, are systems for precipitating particles from gases, which act on the electrostatic principle. These systems are used in particular for the electrostatic purification of waste gases.

Electrostatic filters are mainly used in the purification of industrial flue gases, for example in generating electricity from coal, in smelting, or in cement production. There overall levels of precipitation of up to 99.9% are achieved. A power station filter is in some cases several tens of meters high. The precipitation of in particular toxic fine dusts in the range below one micrometre presents a particular challenge to the precipitation efficiency of electrostatic filters. Such dusts pass into the lungs and therefore cannot be expectorated. Depending on the particular substance, they represent a considerable cancer risk.

Fine dust fractions are however present not only in industrial waste gases, but also in domestic waste gases. In order also to purify these waste gases efficiently, nowadays electrostatic filter systems are installed in chimneys of private and commercial fireplaces and hearths. The installation, maintenance and cleaning of private and commercial fireplaces and hearths and their filter systems are subject to different requirements than large-scale industrial systems. In particular, ongoing industrial solutions for cleaning chimneys are very costly and are not financially feasible for private or commercial use of a fireplace or hearth; instead, in this case cleaning is carried out by chimney sweeps, for example annually. An electrostatic filter system for cleaning flue gases from small fireplaces and hearths that are fired with wood, straw or other regenerative fuels or coal is disclosed in patent specification DE 10 2006 003 028.

In the case of electrostatic filters, dust particles are electrically charged by corona discharge and are attracted to the oppositely charged electrode. The corona discharge takes place on a charged high-voltage electrode suitable for this purpose in the interior of the waste gas chimney. The electrode is designed having projecting tips and possibly sharp edges, since there the density of the field lines and thus also the electric field strength is greatest and therefore the corona discharge is promoted. The counter electrode usually consists of an earthed waste gas tubular section that is placed around the electrode. The precipitation efficiency of an electrostatic filter depends in particular on the residence time of the waste gases in the filter system and the voltage between the discharge electrode and the precipitation electrode. The rectified high voltage required for this purpose is supplied from a high-voltage generation unit. The high-voltage generation unit and the holder for the electrode have to be protected against dust and contamination in order to avoid undesired leakage currents and to prolong the service life of the system.

Known electrostatic filters are illustrated in patent specification GB 914 299. One embodiment of an electrostatic filter (FIG. 2), whose insulators are protected on account of structural measures against bending stresses and fracture, consist at least of a high-voltage part that rests on a carrier that forms a bridge between insulating supports. In addition the suspended high-voltage part extends through an insulator sleeve. Forces acting on the high-voltage part are absorbed by elastic seals, some of which rest directly or indirectly on the high-voltage part. The freedom of movement of the high-voltage part is almost completely prevented by the aforedescribed structure. In so far as a movement of the high-voltage part is possible at all, this is greatly restricted and guided by the adjoining seals. Vibrations and shocks can be damped by this structure.

In patent application GB 2 119 291 an electrostatic filter is illustrated, whose carrier rod, optionally with emission electrode, is freely suspended in an insulator sleeve. In one embodiment, the carrier rod is embedded in a flexible material that fills the space between the carrier rod and insulator. This structure is intended to prevent a fracture of the insulator on account of vibrations that are transmitted via the carrier rod.

In the patent application U.S. Pat. No. 4,671,808 an electrostatic filter with a tapping mechanism is shown. This tapping mechanism serves to shake the large number of electrodes. By actuating the tapping mechanism the precipitate is knocked off.

The publication WO 2008/128353 discloses a damper installation for separating the insulator chamber from the chimney pipe. If the damper installation is closed and the current supply to the holding element for the electrode frame is switched off, the maintenance of the insulator can be carried out while the waste gas continues to flow through the chimney.

The aforementioned prior art provides no details of the structural implementation of holders for electrostatic high-voltage electrodes of mainly small fireplaces and hearths, which are normally cleaned by chimney sweeps using brushes.

Thus, the present invention provides an electrostatic fine dust filter system, in particular an electrode and electrode holder, designed so that the installation, maintenance and cleaning of the fine dust filters and chimney, for example of wood-fired domestic chimneys, can be carried out easily. In particular the cleaning should be able to be carried out easily from the roof as well as from below, i.e. from the fireplace. In addition the safety of chimney sweeps and installers in the execution of the installation, service, maintenance and cleaning operations should be ensured.

SUMMARY OF THE INVENTION

Accordingly, the invention provides a holder and/or an electrode and in particular a fine dust filter system, in that the holder and/or electrode are designed in a moveable and self-restoring, in particular in a resilient manner. In addition the invention provides the use of cambered flexible parts for producing an electrode.

The holder according to the invention for an electrostatic high-voltage electrode for the waste gas purification includes a high-voltage insulator, on the electrode side of the insulator at least one arm (such as only one arm) having a holding means for holding a high-voltage electrode such as vertically suspended on the holding means, and on the insulation side of the insulator at least one installation means for installing the holder at an installation site outside a waste gas duct of a chimney, wherein the holder is equipped with at least one restoring element with a restoring property, which forms an articulated connection between the at least one installation means and the holding means and which allows the holding means and optionally a high-voltage electrode attached thereto to move out of the way from the operating position during cleaning in the waste gas duct with a cleaning device, and allows an automatic return to the operating position. The restoring element is thus incorporated between the at least one installation means and the holding means in such a way that the holding means is connected to the at least one installation means via the restoring element and that the holding means, in relation to the at least one installation means, is moveable in a self-restoring manner, in particular elastic and/or resilient. The at least one restoring element acts in a restoring manner as soon as an external force that changes the position of the holder is lifted. The force of gravity and/or spring forces can act as restoring forces. The deflection from and restoration to the initial position can be repeated arbitrarily. It is advantageous that for example when cleaning with a chimney brush the electrode in the interior of the waste gas duct can on account of the flexibly designed holder be forced to one side and thereby no longer forms an obstruction for the cleaning brush. The at least one restoring element is a moveable element, which can be formed as a spring, e.g. steel spring, as a hinge, mechanical linkage, of elastic material or of a combination thereof.

In particular with embodiments in which the holder is equipped with at least one restoring element with self-restoring spring force (e.g. with a spring as a restoring element or with a holder partly formed of elastic material, for example silicone), the spring restoring element acts in a self-restoring manner as soon as an external force that alters the position of the holder is removed. The deflection from the initial position and the restoration thereto are in this connection elastic. In a further embodiment, in which the holder is provided with at least one hinge as restoring element, the restoring element can act in a restoring manner for example on account of the force of gravity, as soon as an external force that changes the basic position of the holder is removed.

Expediently the at least one restoring element allows a deflection of the holder or parts thereof on account of an external force, and on removal of the external force allows the holder or parts thereof to return to the operating position (i.e. basic position).

Advantageously the at least one restoring element is designed so that the holder, i.e. the part of the holder, which is arranged on the electrode side of the restoring element (i.e. in particular the holding means) can on account of a bending or rotation of the restoring element (in particular about the rotation or bending point of the restoring element) be deflected by more than 5°, such as by more than 10° or by more than 20° from the basic position. The better the deflectability, the better the access when cleaning and maintaining the filter unit and waste gas duct and chimney.

Alternatively, when the at least one restoring element moves away it can be deflected so that the holding element can on account of a bending and/or rotation of the restoring element experience a deflection in relation to the operating position in at least the horizontal direction, of at least 5 cm, at least 10 cm, at least 15 cm and or at least 20 cm, from its operating position. An avoiding movement or deflection in the vertical direction can additionally take place.

Advantageously the at least one installation means is provided with at least one restoring element for supporting the insulator. In this connection at least one carrier means, which carries the at least one restoring element, is arranged between the at least one installation means and the insulator. Alternatively the at least one arm is provided with the at least one restoring element or the insulator is self-restoring, in particular is made of elastic material, such as for example silicone. The restoring element acts in a restoring manner as soon as an external force that changes the position of the holder is removed. Due to the installation-side positioning of the restoring element the largest possible displaceability, i.e. displacement path, of the electrode is ensured. This is particularly advantageous for example when cleaning with a chimney brush, since the electrode in the interior of the waste gas duct can on account of the highly flexible holder be forced back to the wall of the waste gas duct and thus no longer obstructs the cleaning brush.

Advantageously the insulator is connected via a detachable connection, in particular a plug connection, to the at least one installation means, if necessary via at least one carrier means. During the installation the insulator is simply plugged in and can be removed at any time for maintenance. In addition no tools are required for this purpose.

The insulator advantageously sits in an insulator holder, which in addition is deflectably anchored by means of the at least one restoring element on the at least one installation means, optionally via at least one carrier means.

Expediently three, four or more restoring elements are arranged so as to form a restoring three-point, four-point or multi-point support for the insulator. The restoring elements are for example arranged in such a way as to produce a type of spring table, which is positioned between the insulator or insulator holding, and a bracket formed for the installation. The restoring element or elements thus form the supporting legs of the table. Due to the broad support that is achieved when using for example four restoring elements, the torque that is produced on account of the weight of the electrode, possibly an electrode guide, and the forces acting thereon, can be better absorbed. In contrast to a spring support through only one restoring element, the support provided by a plurality of restoring elements is more stable and moreover can be more easily adjusted or dimensioned. On the other hand a spring support with only one restoring element can possibly be achieved structurally more simply, and at the same time ensures a good flexibility and moveability of the holder.

In addition or alternatively restoring elements on the insulator bolt can be placed on the electrode guide and/or the electrode itself. Additional restoring elements can also be formed as springs, for example steel springs, as hinges or mechanical linkages.

The insulator advantageously has a plate-like structure. This advantageously extends upwardly in the shape of a fir-tree, and tapers towards the electrode side. This shape can largely prevent the insulator being covered by dirt. The arm together with holding means for holding an electrode extends in the tapering direction from the tip of the tapering insulator.

The insulator consists for example of silicone, since this material is highly insulating. Silicone itself has a certain elasticity. It is however also conceivable to form the insulator and bolt so that the insulator itself acts or can act as a restoring element. Silicone is also highly water repellent and dirt repellent. Leakage currents can thus be reduced to a minimum and the service life of the unit can be maximised. Furthermore silicone has a high temperature and ozone resistance.

Expediently a power supply unit and optionally a control unit are connected on the installation side to the insulator. In this connection the power supply unit is advantageously connected to the electrode via an electrical connection passing through the insulator.

Expediently a vibration unit, in particular a vibration motor, can be attached to or integrated in the holder. By actuating the vibration unit the holder and thus the fastened electrode can be caused to vibrate. Deposited waste gas particles can be shaken off from the electrode by the induced vibrations.

Advantageously the at least one arm for holding a high-voltage electrode is designed having means for forming a detachable connection, for example a plug connection or a screw-type connection. In this case the at least one arm for holding the high-voltage electrode can be formed having further restoring elements. In addition or alternatively the at least one installation means can be implemented, optionally via at least one carrier element, with a plurality of restoring elements.

The rod-shaped electrode according to the invention, in particular the electrostatic high-voltage electrode, consists of a spring element with a restoring, i.e. elastic, spring force or contains at least one spring element with a restoring, i.e. elastic, spring force, which under the action of a force allows a movement, in particular a bending, buckling or deformation, of the electrode and in the absence of the force allows the electrode to spring back into the basic position, for example into a stretched position. The bending and the restoration are elastic. The electrode thus has on the one hand a rigid and on the other hand an elastic self-restoring structural shape. Since the electrode has one or a plurality of bending or buckling points, it is possible to install and dismantle the electrode from the side via an opening in the waste gas duct. When carrying out cleaning from below, the electrode can be pushed away with the cleaning broom. The work of the chimney sweep is thereby simplified: in particular it is no longer necessary to clean from the roof. In operation the electrode has a high rigidity and at the same time a good damping action. The spring force can be adjusted and dimensioned so that the forces of the waste gas stream, i.e. the thereby generated air resistance at the electrode, and the electrostatic forces acting on the electrode, do not cause the electrode to vibrate. The electrode can be held in the vertical position with an extra weight. The at least one spring element of the electrode can be formed as a spring, for example a steel spring. The at least one spring element is on account of its construction and/or its material properties self-restoring.

Advantageously the spring element consists of at least one cambered spring sheet metal piece, which is cambered transverse to the electrode longitudinal direction. The curvature of the electrode cross-section (i.e. the curvature in the electrode transverse direction of a rod-shaped electrode), which is produced by cambering, advantageously has a radius of 5 to 100 mm, 10 to 40 mm or 18 to 22 mm. Expediently the cross-section of the electrode has an arc length of 8 to 100 mm, 12 to 50 mm or 16 to 25 mm. Advantageously the electrode is 1 to 4 m (meters) long. A rather long electrode is expediently used for a waste gas pipe of rather large diameter. A cambered spring steel sheet has a very high rigidity but can nevertheless easily buckle. As soon as external forces no longer act on the spring steel sheet, it springs back again into the stretched position. Furthermore the buckling point is freely displaceable over the length of the sheet.

In addition the spring element can consist of at least two or more cambered spring sheet metal pieces, which are joined with convex side regions or with convex and concave side regions arranged opposite one another. This more complex structural shape results in a stronger spring force of the electrode.

In one embodiment the rod-shaped electrostatic high-voltage electrode includes spring elements that extend substantially over the whole length of the electrode.

In one embodiment the rod-shaped electrostatic high-voltage electrode contains spring elements and dimensionally stable elements in alternating sequence, in particular in alternating sequence in the longitudinal direction of the electrode. Under bending, a plurality of buckling points can thereby be adjusted simultaneously.

Advantageously the restoring spring force of the spring elements is dimensioned so that the spring elements can be bent or buckled by muscular force, in particular by the use of arms and hands of a person entrusted with the maintenance, installation or cleaning of the unit.

Expediently the restoring spring force of the spring element or elements is dimensioned so that the spring element or elements can be buckled or bent by at least 10°, at least 20°, at least 45° or at least 90°. Furthermore it is advantageous if the individual spring elements can buckle or bend by at least 10 and up to 180°, advantageously by at least 20 and up to 170°. It should be noted that the fewer the spring elements in the structure of the electrode, the more the elements should be able to buckle. The force required for the bending depends in this connection on the material and the dimensions of the rod.

Expediently an electrode has sharp edges or tips for ionisation. The edges or tips have a radius of less than 1 mm, less than 0.5 mm or less than 0.2 mm.

In a further advantageous implementation of a rod-shaped electrode according to the invention, in particular an electrostatic high-voltage electrode, the electrodes consist at least partly of cambered sheet metal, in particular spring steel sheet metal.

Advantageously the electrodes (in particular the electrode surface) consists at least in an amount of 20%, at least 50%, at least 80% or substantially of cambered spring steel sheet metal.

According to the invention cambered spring steels are used to produce rod-shaped electrodes, in particular electrostatic high-voltage electrodes. Due to their self-restoring spring forces these electrodes and the systems in which the electrodes are used are easy to install, maintain and clean.

According to the invention cambered spring steel can be used to produce electrodes, in particular electrostatic high-voltage electrodes.

The electrostatic fine dust filter system according to the invention includes an electrostatic high-voltage electrode and optionally a counter electrode, and is characterised in that the system furthermore includes a holder as described herein for the electrostatic high-voltage electrode.

The electrostatic fine dust filter system according to the invention includes an electrostatic high-voltage electrode and optionally a counter electrode, wherein the system furthermore contains a holder for the high-voltage electrode, which consists in particular of at least one high-voltage insulator, on the electrode side of the insulator an arm with a holding means for holding a high-voltage electrode vertically suspended on the holding means, and on the installation side of the insulator an insulation means for installing the holder, and wherein the holder is furthermore equipped with at least one restoring element with a self-restoring spring force. The restoring element forms an articulated connection between the at least one installation means and the holding means and allows the holding means and optionally a high-voltage electrode attached thereto to move away from the operating position during cleaning in the waste gas duct with a cleaning device, and allows a self-restoring to the operating position. The restoring element acts in a self-restoring manner as soon as an external force changes the position of the holder. This has the advantage that for example when cleaning with a chimney brush, the electrode in the interior of the waste gas duct can be forced towards the side on account of the flexible holder and thus no longer forms an obstruction for the cleaning brush.

Advantageously in this connection the high-voltage electrode is formed as a rod-shaped electrode, which contains at least one restoring element with a restoring spring force, which allows the electrode to buckle under the action of a force and in the absence of a force the electrode stiffens.

The electrostatic fine dust filter system according to the invention includes an electrostatic high-voltage electrode and optionally a counter electrode, and is characterised in that the high-voltage electrode is formed as a rod-shaped electrostatic high-voltage electrode as described hereinbefore.

The electrostatic fine dust filter system according to the invention contains an electrostatic high-voltage electrode and optionally a counter electrode, wherein the high-voltage electrode is formed as a rod-shaped electrostatic high-voltage electrode, which includes in particular at least one restoring element with a restoring spring force, which under the action of a force allows the electrode to buckle and in the absence of a force the electrode stiffens. Due to the fact that the electrode has one or a plurality of bending or buckling sites, it is possible to assemble and dismantle the electrode from the side via an opening in the waste gas duct. The opening in the chimney can be kept to the minimum size on account of the maximum dielectric distance. The design of a chimney does not impose any major restriction as regards the concept and design of the filter system, since a side opening is sufficient as inlet for the electrode. All other filter elements can be installed outside on the chimney.

Advantageously the electrostatic fine dust filter system furthermore includes a flexible insulating holder, a high-voltage insulator, on the electrode side of the insulator at least one arm with a holding means for holding a high-voltage electrode vertically suspended on the holding means, and on the installation side of the insulator at least one installation means for installing the holder, wherein the holder is equipped with at least one restoring element. The restoring element forms in this connection an articulated connection between the at least one installation means and the holding means and allows the holding means and optionally a high-voltage electrode attached thereto to move away from the operating position during the cleaning with a cleaning device in the waste gas duct, and allows a self-restoring to the operating position. In one embodiment the holder is equipped with at least one restoring element with self-restoring spring force.

These and further advantages and advantageous embodiments are illustrated in the following description.

BRIEF DESCRIPTION OF THE DRAWINGS

The invention is described in more detail hereinafter with reference to the figures in schematic representation, in which.

DETAILED DESCRIPTION OF THE ILLUSTRATED EMBODIMENTS

Figure 1:
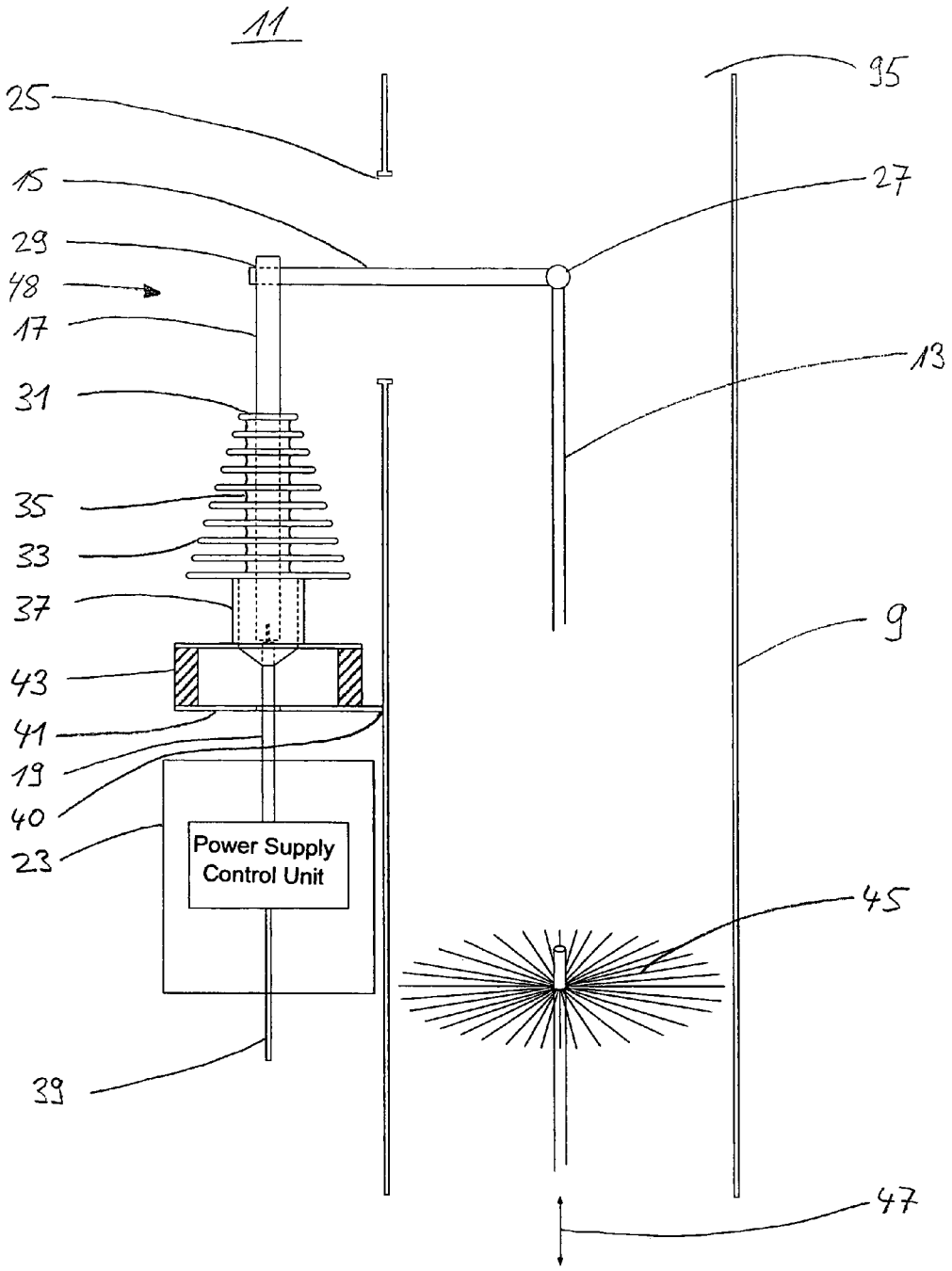
FIG. 1 shows a waste gas duct with electrostatic high-voltage filter equipment with an insulator flexibly mounted via restoring elements and an electrostatic electrode in the operating position.

FIGS. 1-3 and 8 show in each case a waste gas duct 9 of a chimney, which is equipped with an electrostatic high-voltage filter system 11. A chimney is designed so that waste gases can flow upwardly through the waste gas duct 9 to the outside. The waste gas duct is designed for this purpose for example as a pipe. Commercially available and constructed waste gas pipes normally have diameters of about 100 to 400 mm. In operation according to FIG. 1 the electrostatic high-voltage electrode 13 is positioned in the interior of the waste gas duct 9 centrally in the axial direction (i.e. in the longitudinal direction). The inner wall of the waste gas duct 9 forms the counter electrode or has fastenings for one or a plurality of counter electrodes attached thereto. The counter electrode can be earthed. The high-voltage electrode 13 is connected via an electrode guide 15, an insulator bolt 17 and a high-voltage cable 19 to an electronic high-voltage generation and control device 23. The electrode guide 15 is led outwardly through an opening 25 in the wall of the waste gas duct 9. On the electrode side the electrode guide 15 is formed with an electrode fastening 27, to which the high-voltage electrode 13 is attached or is detachably fastened. Alternatively the electrode guide 15 and electrode 13, electrode guide 15 and insulator bolt 17 or all three components form a rigidly connected unit. On the insulator side the electrode guide 15 is formed so that it can be detachably inserted into a coupling 29 connecting the insulator bolt 17 and electrode guide 15. In one of its simplest embodiments the coupling 29 simply consists of an aperture-like guide in the insulator bolt 17. The insulator bolt 17 carries an insulator 31, which is of a plate-like structure and tapers to the electrode side, wherein the plates 33 form spaced-apart layers of radial enlargements of the basic diameter 35 of the insulator 31. The insulator bolt 17 extends—in particular in the tip direction—from the tip of the insulator, and passes on this side into the electrode guide 15 and the electrode fastening 27. The insulator bolt 17 and electrode guide 15 form an arm with the electrode fastening 27 for holding an electrode 13. The insulator 31 detachably engages in an insulator holder 37, which is designed so that in the inserted position a high-voltage cable 19 forms an electrical connection between the insulator bolt 17 and high-voltage generation and control electronics 23. The electrical connection between the insulator bolt 17 and high-voltage cable 19, like also the high-voltage cable itself, are electrically insulated with respect to the bracket 41 and the restoring element 43. A power supply 39 provides the electric current. The insulator holder 37 is flexibly mounted on a bracket 41. The bracket 41 is fixedly secured to an installation site 40 on the chimney 9 by means of an installation means (not shown). Restoring elements 43 provide flexibility, so that a force acting on the electrode 13, electrode guide 15 or insulator bolt 17 can be absorbed by a change in a position and when the force exerted is lifted the electrode can return in a restoring or resilient manner to the basic position. The restoring elements 43 act at the same time as linkages, buckling points and stores for the restoring force. Advantageously a plurality of restoring elements 43 is used. In one embodiment four similar restoring elements are used. The four restoring elements form the corner points of a square or rectangle and anchor the insulator holder 37 in a supporting manner on the bracket 41.

Detachable connections mean in the present context connections that can easily be released, or detached and restored manually by the maintenance worker or chimney sweep, as is possible for example with a plug connection, a clamp connection or screw connection.

Figure 2:
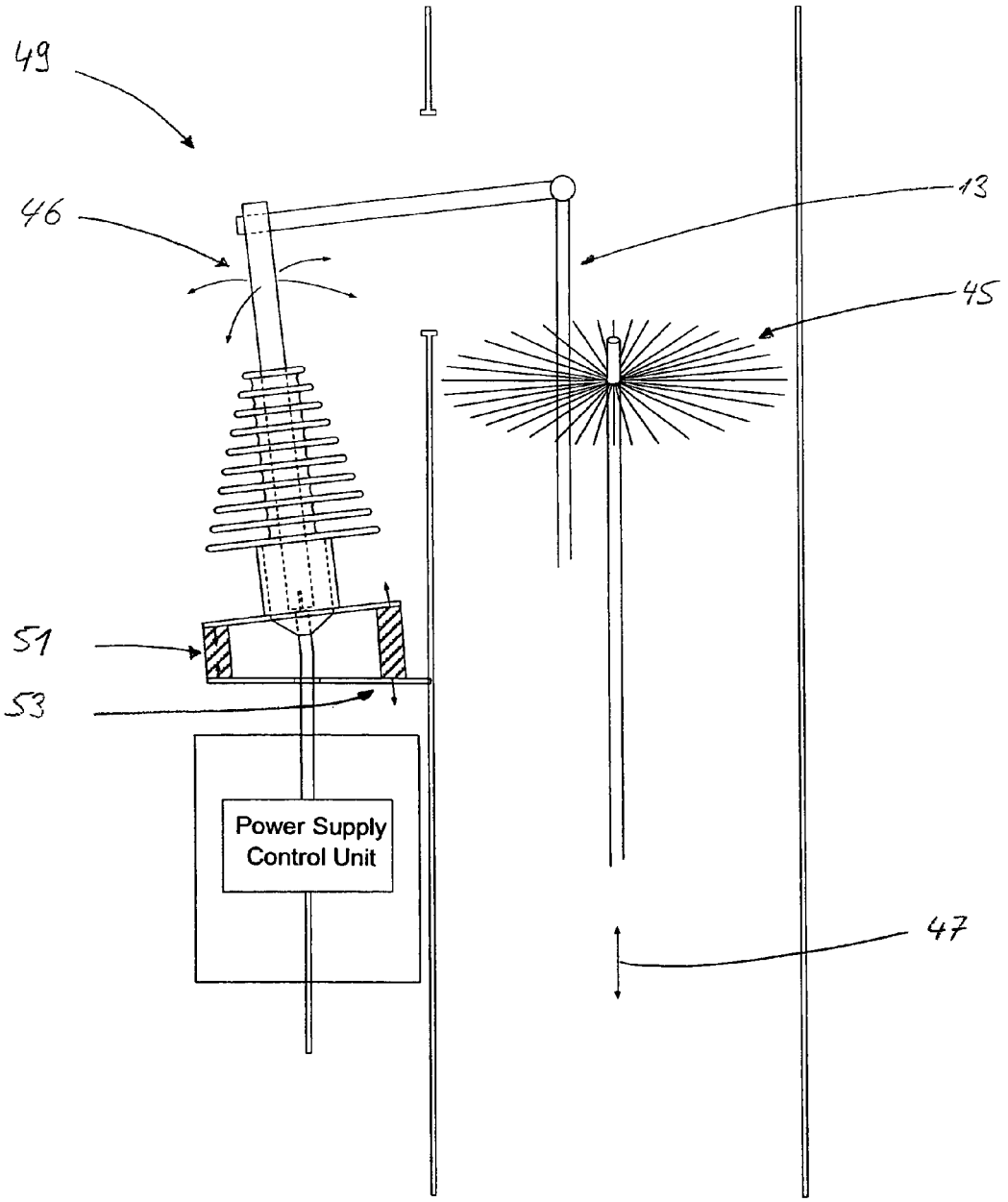
FIG. 2 shows a waste gas duct with electrostatic high-voltage filter equipment with an insulator flexibly mounted via restoring elements and an electrostatic electrode in the deflected position during the cleaning.

The aforedescribed flexible mounting of the high-voltage insulator 31 and high-voltage electrode 13 means that the electrode 13 and the electrode guide 15 can avoid for example a force exerted by a cleaning brush 45. Entanglement or suspension of the cleaning brush 45 on the electrode 13 or electrode guide 15, as well as a deformation of the electrode 13 or electrode guide 15, can be prevented with this arrangement. The avoiding movement 46 of the whole electrode holder 45 and of the high-voltage filter system 11 on account of the force exerted in the cleaning movement 47 of a cleaning broom 45 is illustrated in FIG. 2. On account of the impact forces during the cleaning operation the electrode holder 49 is greatly deflected. Compressive forces 51 and tensile forces 53 acting on the restoring elements produce a buckling and deflection of the holder 48 from its original position, so that the axis of the bolt tilts. As a departure from the situation illustrated in FIG. 2, the avoiding movement 46 can deflect the electrode holder 48, 49, in particular the insulator 31, also towards the chimney 9. In this situation the shape of the insulator 31 proves advantageous, since even with a slight distance between the insulator 31 and the outer wall 9 of the chimney an avoiding movement with useful span width to the chimney 9 is possible due to the tapering shape.

Figure 3:
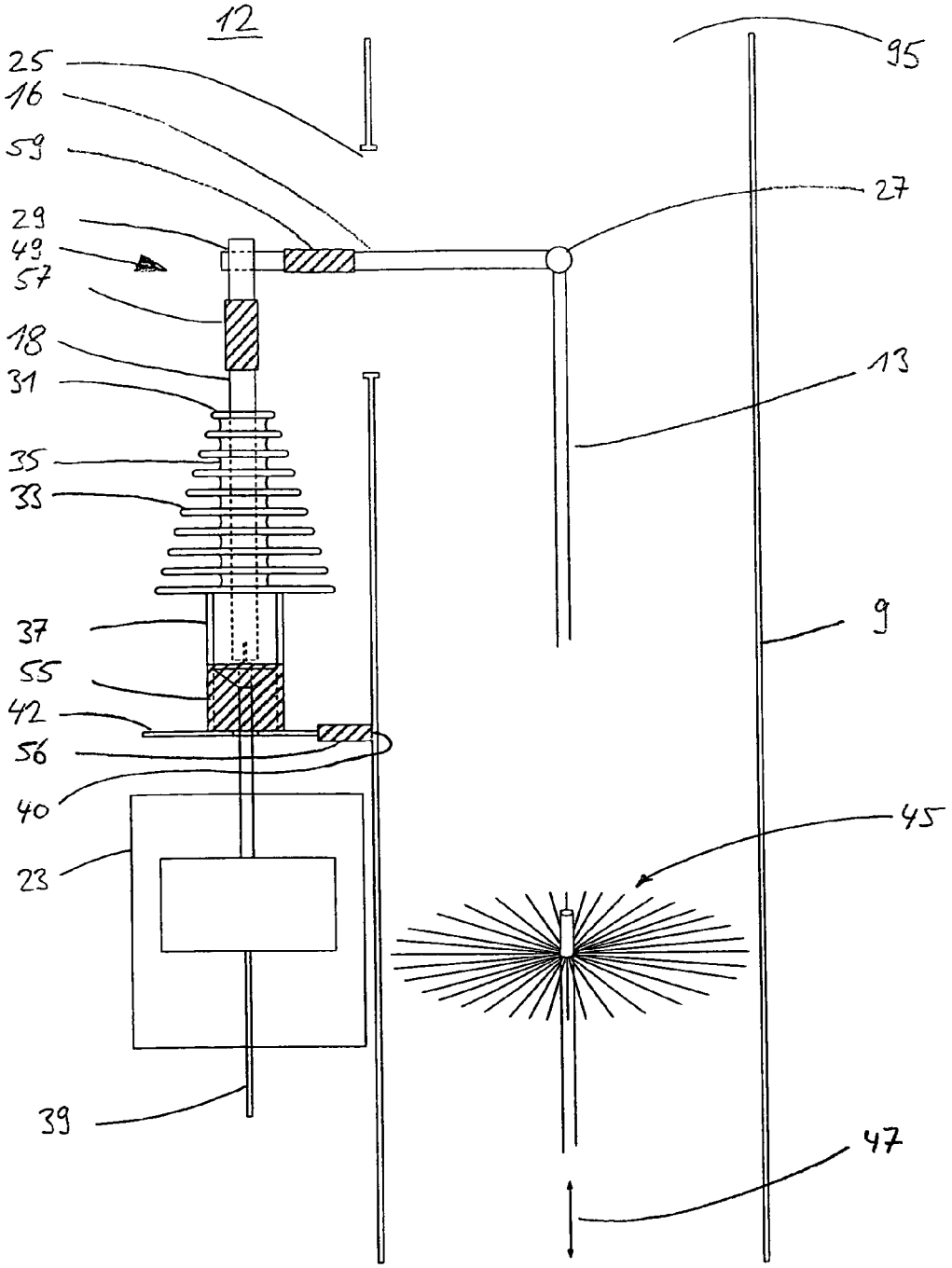
FIG. 3 shows a waste gas duct with electrostatic high-voltage filter equipment with a flexibly mounted insulator and electrostatic electrode with alternative and additional restoring elements or buckling points.

The electrode holder 49 of a high-voltage filter system 12 with a single alternative restoring element 55 is illustrated in FIG. 3. The alternative restoring element 55 supports the insulator holder 37 on the bracket 42. In addition optional restoring elements 57 and 59, which are integrated in the insulator bolt or in the electrode guide, are also shown. These further or alternative restoring elements form buckling points that further improve or possibly alone ensure the mobility and flexibility of the electrode holder 49. All restoring elements described here can be of arbitrary construction. By way of example there may be mentioned here simple mechanical linkages, springs, fixed-body linkages or elastomers.

The restoring elements 57 and/or 59 additionally or alternatively placed on the insulator bolt 18 or on the electrode guide 16 consist advantageously for spatial reasons of a spring, a hinge or a linkage.

Figure 4:
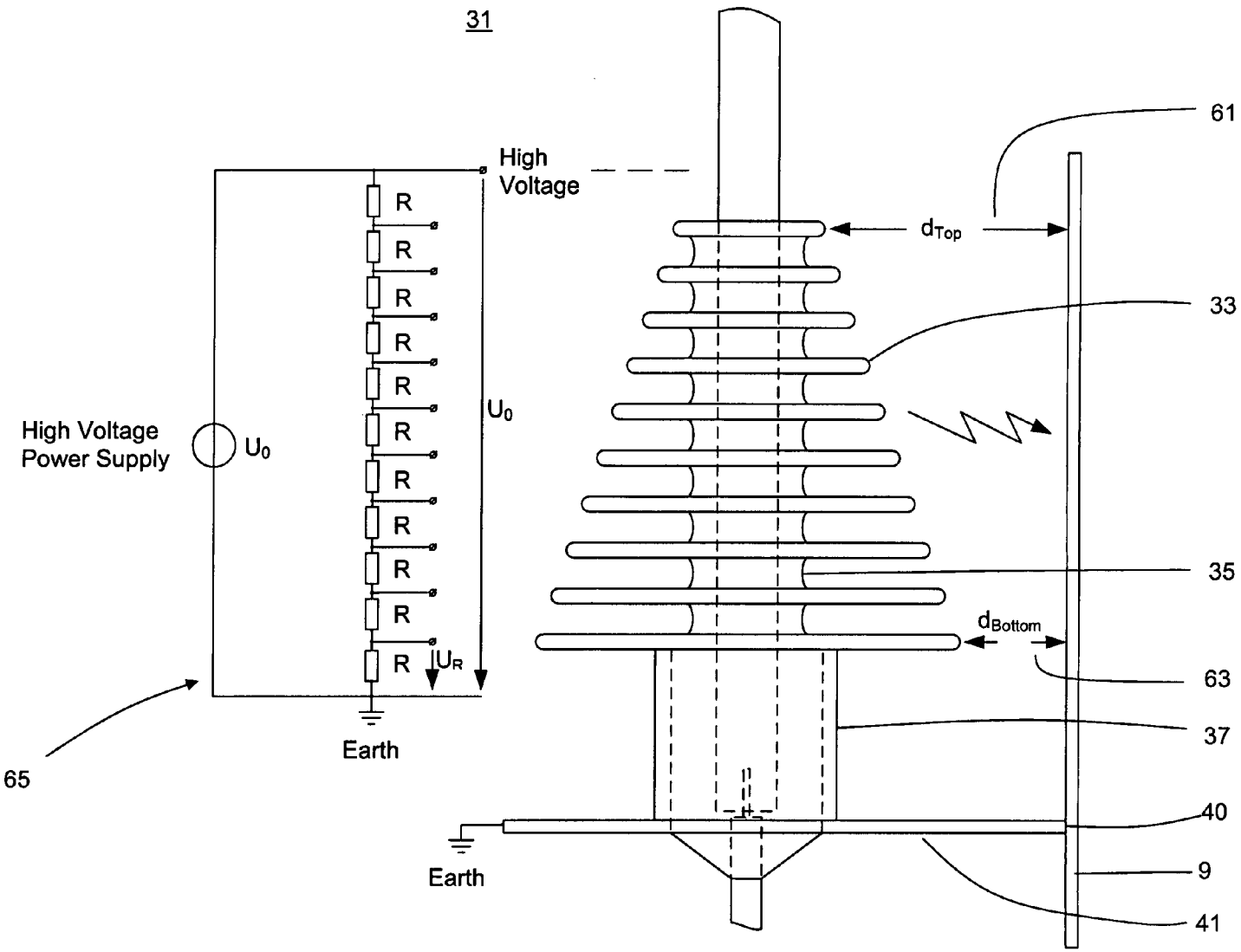
FIG. 4 shows an insulator.

The insulator 31 is shown in detail in FIG. 4 (here mounted in an insulator holder 37 without a resilient element on the installation bracket 41). The insulator 31 is mounted in a positive engagement and frictional manner on an insulator holder 37. No screws or other fixing means are required for this purpose. The insulator 31 extends and thus tapers upwardly. This shape allows a minimal installation size of the fine dust filter 11 or 12. The dimensions of the insulator 31 as well as of the overall filter 11 or 12 are defined by the dielectric distances. Due to the tapering shape (fir-tree shape) the insulation distance 61 and thus the dielectric distance increases in the upper region. In the lower region the voltages are less on account of the potential drop, so that the insulation distance 63 can be kept small. The equivalent circuit diagram 65 is shown on the left-hand side of FIG. 4. Each ohmic resistor R forms a plate of the insulator 31. An advantageous insulator material is silicone. Silicone has a high temperature and ozone resistance. Due to its hydrophobic property it is water and dirt repellent, and leakage currents can thus be reduced to a minimum. The service life of the filter 11 or 12 is thereby maximised. Due to the lamellar shape an electrically conducting dirt layer can form only with interruptions, and the lamellar structure thus prevents a voltage breakdown on the outer surface of the chimney. In an alternative embodiment the insulator bolt 17 can be designed flexibly. In this way it is possible, in combination with an elastic insulator material such as silicone, for the insulator 31 to act elastically in a restoring manner.

Figure 5:
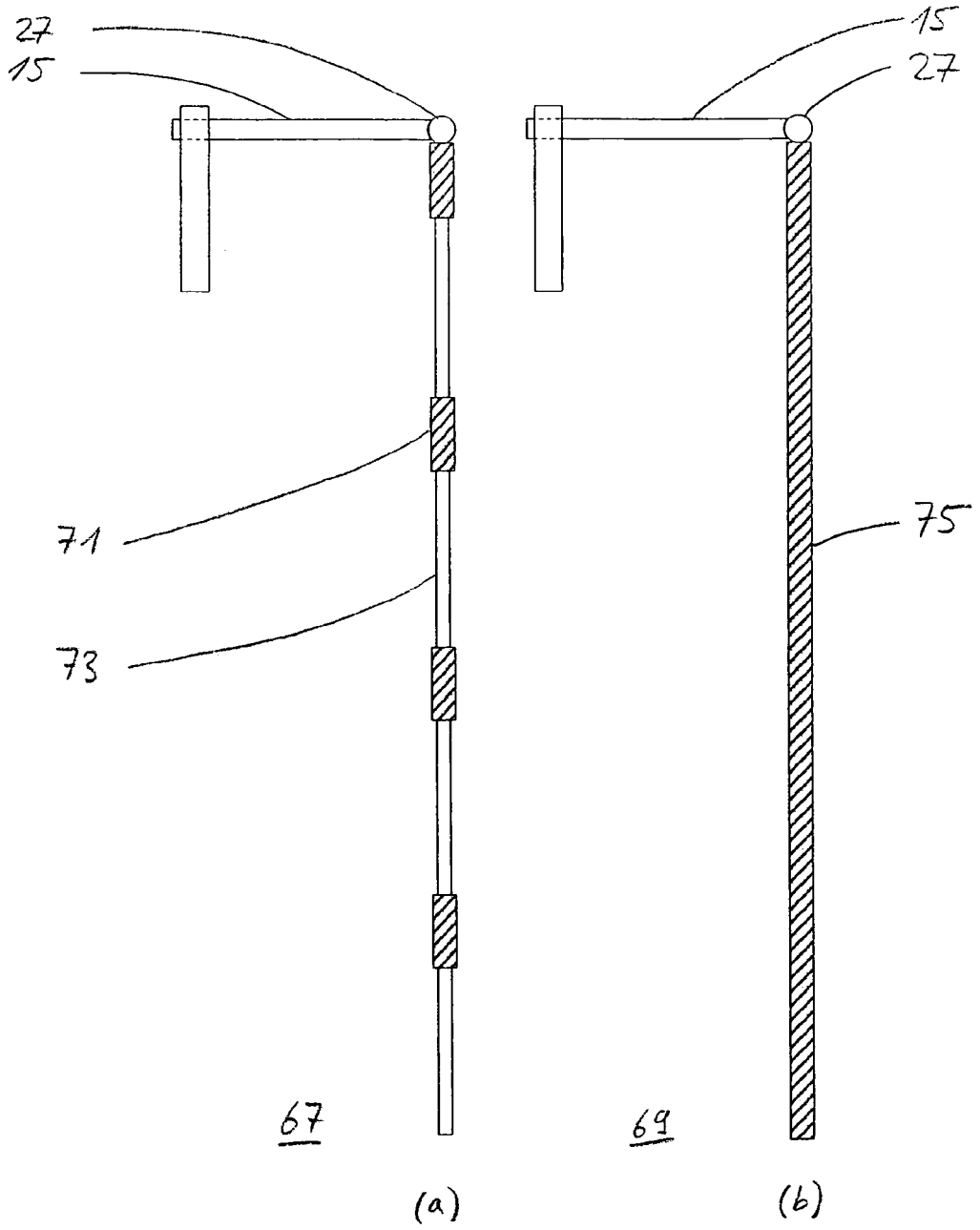
FIG. 5 shows two general embodiments of a self-restoring electrostatic electrode: a) segmented construction, b) unitary construction.
Figure 6:
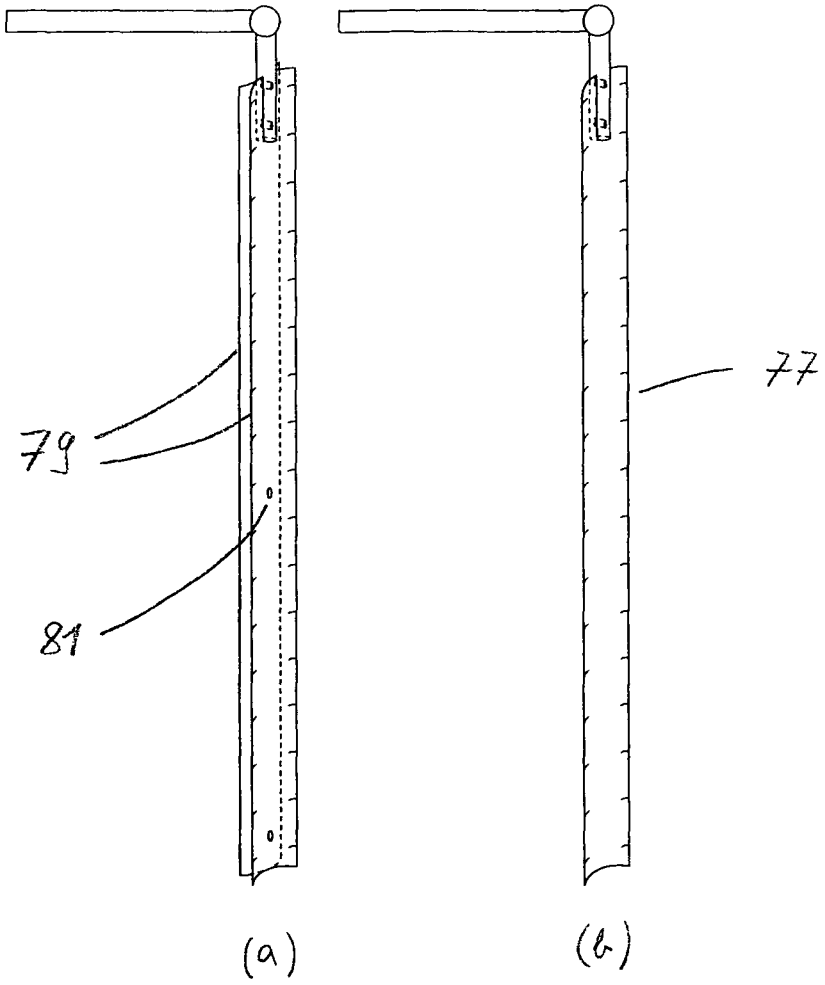
FIG. 6 shows self-restoring electrostatic electrodes containing a) two cambered spring metal sheets, b) one cambered spring metal sheet.
Figure 7:
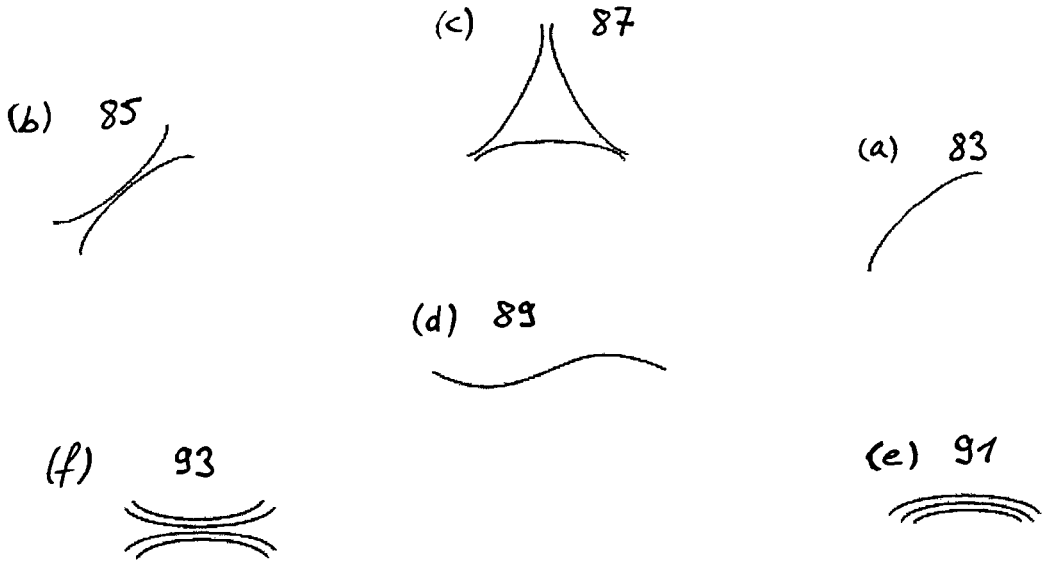
FIG. 7 shows examples of cross sections of self-restoring spring sheet metal electrodes.

In order to improve the flexibility and moveability of the system still further, the electrode 13 itself can also be designed flexibly. Two general embodiments of a rod-shaped self-restoring electrostatic high-voltage electrode 67 and 69 are illustrated in FIG. 5: in one embodiment (electrode 67 in FIG. 5*a*) segmented in the longitudinal direction, flexible, self-restoring elements 71 and rigid, dimensionally stable elements 73 are alternately arranged. In another, one-part embodiment, i.e. non-segmented in the longitudinal direction (electrode 69 in FIG. 5*b*), the electrode consists of a single self-restoring resilient element 75. Self-restoring resilient elements 71 and 75 can be designed for example as cambered chrome steel spring sheets. A rod-shaped sheet metal strip 77, which is curved perpendicularly to its longitudinal axis, is illustrated in FIG. 6*a*. A non-cambered long sheet metal piece can be bent relatively easily in the longitudinal direction. If such a sheet metal piece is curved or cambered transverse to its longitudinal direction, this has a stiffening effect. To bend the piece in its longitudinal axis now requires a greater force than is the case with a non-cambered sheet metal strip; in addition the stretched shape of the sheet metal strip is formed resiliently with a greater spring force. Two cambered sheet metal strips 79, which are connected to one another on their respective convex sides, in other words back to back, via connecting points 81, such as for example rivets, are shown in FIG. 6*b*. Further cross-sections of possible shapes and arrangements of cambered sheet metal strips are illustrated in FIG. 7. The curved shape of a cross-section of an individual cambered spring sheet metal strip 83 is illustrated in FIG. 7*a*. The arrangement of two sheet metal strips 85 with their respective convex sides pressed against one another is shown in cross-section in FIG. 7*b*. The arrangement of three sheet metal strips 87 with their convex sides at the respective two end regions pressed respectively against one of the other two sheet metal strips is illustrated in FIG. 7*c*. A cross-section of an S-shaped curved spring sheet metal strip 89 is shown in FIG. 7*d*. The arrangement of three sheet metal strips 91 is shown in cross-section in FIG. 7*e*, wherein the sheet metal strips are stacked convex side to concave side against one another. An arrangement of four sheet metal strips 93 is shown in cross-section in FIG. 7*f*, wherein two first sheet metal strips are arranged with their respective convex sides against one another and the two further sheet metal strips are arranged with their convex sides against the concave outer sides of the first two sheet metal strips. Sheet metal strips with these cross-sections and these arrangements or with similar cross-sections and arrangements can be used as electrodes 75 or as electrode sections 71 in conjunction with rigid intermediate elements 73 according to FIGS. 5*a* and 5*b*. Advantageously the edges of the sheet metal strips taper as far as possible to a tip, so that the electrostatic corona discharge takes place as homogeneously and reliably as possible.

Figure 8:
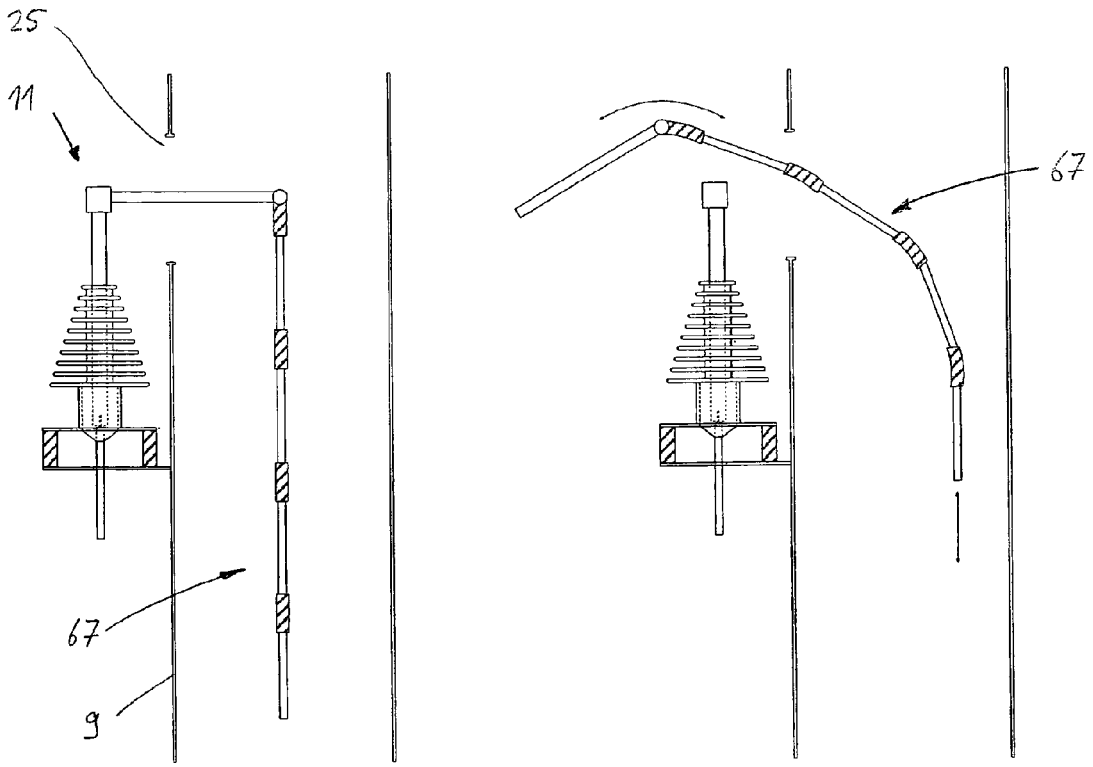
FIG. 8 shows a waste gas duct with electrostatic high-voltage filter equipment with flexibly mounted insulator and flexible electrostatic electrode, a) in the operating position, b) with the electrode removed.

In FIG. 8 the alignment and curvature of a self-restoring high-voltage electrode 67 are compared in the operating position (FIG. 8*a*) and when the electrode is removed during maintenance for example (FIG. 8*b*). Due to the restoring spring force the electrode is stretched in the operating position (FIG. 8*a*). The spring force produces electrical forces that could cause the electrode 67 to vibrate. When the electrode 67 is removed from the waste gas duct 9 the latter buckles on account of the muscular force exerted by the person entrusted with the maintenance, installation or cleaning of the system, the removal of the electrode 67 thereby being facilitated.

The electrode holder 48 or 49 and electrodes 13 are described hereinafter as regards their functioning. The waste gas ascending in the waste gas duct 9 of a chimney with an aforedescribed filter system 11 or 12 is field ionised when passing in the vicinity of the electrode 13. Dust particles are thereby electrostatically charged and are precipitated on the counter electrode. The inner surface of the waste gas duct 9 can for example serve as counter electrode. The dust particle precipitate that forms is removed from time to time in smaller systems, such as for example in domestic fireplaces and hearths and wood-fired heating systems, by the chimney sweep. In the system according to the invention the cleaning can be carried out from below or from above. The procedure is however often prescribed by the specific regional authority.

In cleaning from below, in other words from the fireplace or hearth, cleaning brooms and brushes 45 are forced upwards, possibly manually. If the electrode 13 itself is flexible or its holder 48 or 49 is mounted flexibly, then the electrode 13 and possibly the flexible electrode holder 48 or 49 are pushed sideways and/or upwards by the brush 45. The electrode 13 thus presents no obstacle to the aforedescribed cleaning, which can be carried out quickly and safely.

For cleaning or maintenance work from above, in other words from the roof, the flexible electrode holder 48 or 49 can on account of its flexibility simply be forced sideways and the electrode 13 can be removed if necessary. To remove the electrode 13, this or the electrode guide 15 or 16 is taken from its holder and removed through the electrode insertion opening 25 from the waste gas duct 9. If a flexible electrode 13 (such as for example the electrode 67 or 96 according to FIG. 5) was installed, this workstep is particularly simple since the bendable electrode buckles when gripped or deflected from the vertical and can thereby easily be withdrawn through the narrow opening 25. If considered necessary, the insulator 31 together with the bolt 17 or 18 can also be removed. The opening 25 of the waste gas duct 9 thus becomes freely accessible. Neither the electrode 13 nor the electrode holder 48 or 49 thus presents any obstacle to the aforedescribed cleaning, which can be carried out quickly and safely. Dismantling and reassembly are quick and uncomplicated. Since the individual parts to be moved are relatively small and easy to handle, this facilitates the work of the chimney sweep and thus ensures his safety.

It is conceivable when cleaning from the roof simply to move the electrode holder 48 or 49 and the electrode 13 sideways on account of their flexibility, without dismantling them, and to insert the cleaning brush from the waste gas outlet opening 95 or from the electrode insertion opening 25 into the waste gas duct 9.

If simply a flexible electrode 13 (for example the electrode 67 or 96 according to FIG. 5) is installed, but the electrode holder is rigid (for example if the springs 43, 55, 56, 57, 59 according to FIGS. 1 and 3 are not present), the waste gas duct 9 and electrode 13 can still be maintained and/or cleaned from the roof. The flexible electrode can in this connection be removed from the holder and on account of its flexibility can be withdrawn through the electrode insertion opening 25 from the waste gas duct 9.

The restoring spring forces are all calculated so that although the springs yield slightly under the forces exerted during cleaning and maintenance, nevertheless under operating conditions the system parts remain fixed with respect to the chimney and do not experience vibrations.

The invention claimed is:

1. An electrostatic fine dust filter system, comprising:

an electrostatic, rod-shaped high-voltage electrode having at least one spring element with a restoring force, wherein the spring element under an external force allows at least one of bending and buckling of the electrode, and in the absence of the external force restores the electrode to an operating position;

a holder for the electrostatic high-voltage electrode, wherein the holder comprises a high-voltage insulator and, on an electrode side of the insulator, at least one arm containing a holding device for holding the high-voltage electrode, on an installation side of the insulator, at least one installation device for installing the holder on an installation site outside a waste gas duct of a chimney, and at least one restoring element forming an articulated connection between the at least one installation device and the holding device that enables the holding device to move out of the way from the operating position during cleaning of the waste gas duct and allows an automatic return to the operating position.

2. The electrostatic fine dust filter system of claim 1, further comprising a counter-electrode.

3. The electrostatic fine dust filter system of claim 1, wherein the at least one restoring element comprises at least one of a spring, a steel spring, a hinge, a mechanical linkage, and an element comprised at least in part of a self-restoring, elastic or resilient material.

4. The electrostatic fine dust filter system of claim 1, wherein the insulator is connected via a detachable connection to the at least one installation device or to at least one carrier device.

5. The electrostatic fine dust filter system of claim 1, wherein the insulator sits in an insulator holder and the insulator holder is anchored by the at least one restoring element to the at least one installation device.

6. The electrostatic fine dust filter system of claim 1, wherein the insulator sits in an insulator holder and the insulator holder is anchored by at least one carrier to the at least one installation device.

7. The electrostatic fine dust filter system of claim 1, wherein the at least one arm is provided with structure for forming a detachable connection.

8. The electrostatic fine dust filter system of claim 1, wherein the at least one arm is provided with a plug connection for forming a detachable connection.

9. An electrostatic fine dust filter system, comprising:

an electrostatic high-voltage electrode; and a holder for the electrostatic high-voltage electrode, wherein the holder comprises a high-voltage insulator and, on an electrode side of the insulator, at least one arm containing a holding device for holding the high-voltage electrode, on an installation side of the insulator, at least one installation device for installing the holder on an installation site outside a waste gas duct of a chimney, and at least one restoring element forming an articulated connection between the at least one installation device and the holding device that enables the holding device to move out of the way from the operating position during cleaning of the waste gas duct and allows an automatic return to the operating position.

10. The electrostatic fine dust filter system of claim 9, wherein the electrostatic high-voltage electrode is rod-shaped having at least one spring element with a restoring force, wherein the spring element under an external force allows at least one of bending and buckling of the electrode, and in the absence of the external force restores the electrode to an operating position.

11. The electrostatic fine dust filter system of claim 9, further comprising a counter-electrode.

12. The electrostatic fine dust filter system of claim 9, wherein the at least one restoring element comprises at least one of a spring, a steel spring, a hinge, a mechanical linkage, and an element comprised at least in part of a self-restoring, elastic or resilient material.

13. The electrostatic fine dust filter system of claim 9, wherein the insulator is connected via a detachable connection to the at least one installation device or to at least one carrier device.

14. The electrostatic fine dust filter system of claim 9, wherein the insulator sits in an insulator holder and the insulator holder is anchored by the at least one restoring element to the at least one installation device.

15. The electrostatic fine dust filter system of claim 9, wherein the insulator sits in an insulator holder and the insulator holder is anchored by at least one carrier to the at least one installation device.

16. The electrostatic fine dust filter system of claim 9, wherein the at least one arm is provided with structure for forming a detachable connection.

17. The electrostatic fine dust filter system of claim 9, wherein the at least one arm is provided with a plug connection for forming a detachable connection.

* * * * *